US006757944B2

(12) United States Patent
Buscart

(10) Patent No.: US 6,757,944 B2
(45) Date of Patent: Jul. 6, 2004

(54) SIDE RELEASE BUCKLE WITH SPRING

(75) Inventor: Jordi Badrenas Buscart, Barcelona (ES)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/366,744

(22) Filed: Feb. 14, 2003

(65) Prior Publication Data

US 2003/0196302 A1 Oct. 23, 2003

Related U.S. Application Data

(60) Provisional application No. 60/373,353, filed on Apr. 17, 2002.

(51) Int. Cl.[7] ..... A41F 1/00

(52) U.S. Cl. ..... 24/614; 24/200; 24/580; 24/617; 24/621; 24/625; 24/666

(58) Field of Search ..... 24/614, 625, 701, 24/580, 666, 617, 621, 200

(56) References Cited

U.S. PATENT DOCUMENTS

| | | | | | |
|---|---|---|---|---|---|
| 1,999,167 | A | * | 4/1935 | White | 24/200 |
| 3,075,268 | A | * | 1/1963 | Schwartz | 24/200 |
| 5,465,472 | A | * | 11/1995 | Matoba | 24/625 |
| 5,893,199 | A | * | 4/1999 | Anscher | 24/625 |
| 5,991,986 | A | * | 11/1999 | Canna et al. | 24/625 |
| 6,148,486 | A | * | 11/2000 | Uehara et al. | 24/614 |
| 6,263,548 | B1 | * | 7/2001 | Ikeda | 24/625 |
| 6,378,466 | B1 | * | 4/2002 | Oyster et al. | 24/625 |
| 6,460,232 | B2 | * | 10/2002 | Maruoka | 24/614 |

* cited by examiner

*Primary Examiner*—Victor Sakran
(74) *Attorney, Agent, or Firm*—Mark W. Croll; Paul F. Donovan

(57) ABSTRACT

A two-part buckle is provided with springing structure associated with web securing structures of the buckle parts, and with structure allowing deflection within the buckle part to at least partly absorb tensile forces applied to the buckle.

13 Claims, 2 Drawing Sheets

SIDE RELEASE BUCKLE WITH SPRING

CROSS-REFERENCE TO RELATED APPLICATION

This application claims benefit to U.S. Provisional Application Serial No. 60/373,353, filed on Apr. 17, 2002.

FIELD OF THE INVENTION

The present invention relates generally to two part buckles having interconnecting male and female components used on clothing, sporting gear, luggage, safety equipment and the like.

BACKGROUND OF THE INVENTION

Buckles are known for use in many different constructions, including, for example, clothing, sporting gear, luggage, safety and other equipment and the like. Two-part buckle assemblies are known in a variety of different constructions. In a two-part buckle, cooperating first and second buckle parts are provided with structure having interlocking components, allowing releasable locking engagement of the components.

For a two-part buckle, it is known to provide a female buckle component attached to one part of an article, and a male buckle component attached to another part of the article. For example, the female component may be anchored to a bag or luggage, and the male component attached directly to a lid, cover or flap of the bag or luggage. Alternatively, one or both of the components may be attached to a strap or the like. It is known also to provide the male and female components on opposite ends of a strap or belt, or on separate straps of articles to be connected together. The female buckle component defines a chamber or pocket having one or more windows. The male buckle component includes one or more arms slidable into the pocket, with projections of the arms extending in to each window defined in the female buckle component. Engagement of the projections from the arms in the windows of the pocket serves to lock the two parts together. Disengagement is achieved by pressing the projections out of the windows, while pulling the male and female components apart. Pressing the projections deflects the arms, and the thickness and resilience of the arms directly affect the resistance to disengagement of the male and female buckle parts.

Two-part buckles also are used on adjustable straps such as sport helmet straps, shoulder and waist straps of backpacks, bags and the like. To provide straps of adjustable length, one or both of the buckle parts can be secured to the strap it anchors by a serpentine wrapping of the strap through two or more bars of the buckle part. The remaining buckle part can be attached to the strap it anchors by simple wrapping and sewing, if length adjustability is required for only one buckle part.

A problem can be experienced with two-part buckles when tensile load is applied to the buckle, normally through the straps. Buckles on shoulder straps of bags, for example, can experience a slow increase in tensile load, as the bag is lifted by one or more straps. The buckle also will experience sustained, relatively constant tensile load if the bag is carried or held with the strap or straps supporting the weight of the bag. The buckle also can experience shock load if the bag, for example, is jerked or tugged from a support. Sporting equipment, safety equipment and other such applications may exert such shock load forces as a result of their intended use. Such loads are applied directly against the locking features of the male and female buckle components. The buckle components must be sufficiently robust to withstand such forces without breaking or become disengaged unintentionally. However, simply making the arm or arms of the male buckle component stiffer or thicker to resist breaking can make it unacceptably resistant to intentional deflection for intended disengagement of the buckle. To make the buckle easier to operate, the arms can be made longer. However, the resulting increased buckle size is undesirable in some applications and uses.

What is needed in the art is a two-part buckle structure that can absorb shock loads and resist sustained or more gently increasing loads without breaking.

SUMMARY OF THE INVENTION

The present invention provides springing structure integral with the structure of the buckle parts so that loads exerted thereon can be absorbed.

In one form thereof, the present invention provides a two-part buckle with a female buckle part defining a pocket and including a first strap securing structure. A male buckle part includes a forward portion insertable into the pocket, and a second strap securing structure. The female buckle part and the male buckle part define cooperative, releasable locking structure, and springing structure for absorbing load exerted on the locking structure.

In another form thereof, the present invention provides a male buckle part for a two-part buckle having a female buckle part defining a pocket having lateral windows and a slot. The male buckle part has a body and first and second spaced arms extending from the body and adapted and arranged for sliding into and out of the pocket in the female buckle part. The arms have lateral projections received in the windows. A brace between the arms is connected to each arm near the body, and has a central portion angling away from the body.

In still another form thereof, the present invention provides a strap securing structure for a device to be held on a strap, including a deflectable portion about which a strap can be wrapped, adapted for yielding to load applied against the strap securing structure by a strap secured thereto, and a less deflectable portion associated with the deflectable portion to be jointly wrapped therewith by a strap.

An advantage of the present invention is providing buckle parts that can better absorb forces such as tensile load applied thereto through attached straps, without breaking or disconnecting.

Another advantage of the present invention is providing a male buckle part for a two-part buckle with stronger arms less likely to break, yet which can be deflected readily for operation and use of the buckle.

Still another advantage of the present invention is providing a buckle design that uses material efficiently, is compact and provides increased load bearing capabilities for the size of the buckle.

Other features and advantages of the invention will become apparent to those skilled in the art upon review of the following detailed description, claims and drawings in which like numerals are used to designate like features.

Figure 1:
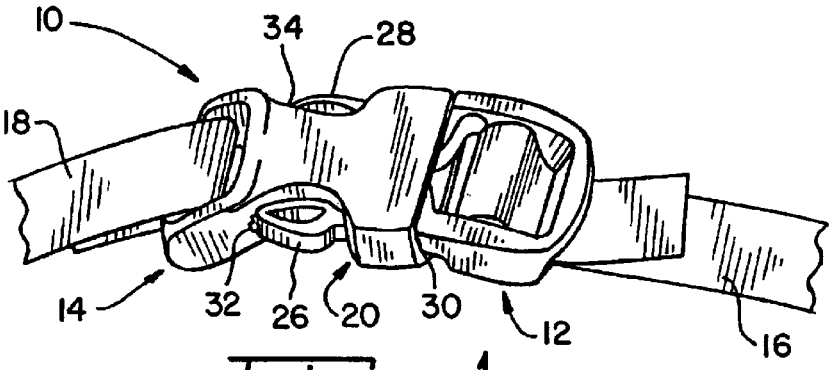
FIG. 1 is a perspective view of a two-part buckle in accordance with the present invention, showing the top of the buckle with the two parts thereof illustrated in connected arrangement.

Before the embodiments of the invention are explained in detail, it is to be understood that the invention is not limited in its application to the details of construction and the arrangements of the components set forth in the following description, or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising," and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings, and to FIG. 1 in particular, a two-part buckle 10 in accordance with the present invention is shown. Buckle 10 includes a male buckle part 12 that can be received and releasably locked in a female buckle part 14. Buckle 10 can be made of a variety of materials, with numerous plastics being suitable.

Figure 2:
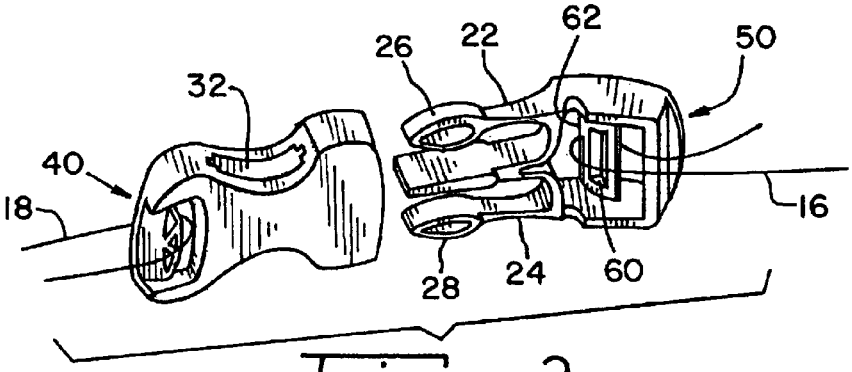
FIG. 2 is a perspective view, substantially from the bottom, showing the two-part buckle of FIG. 1, with the two parts thereof illustrated in a disconnected arrangement.
Figure 3:
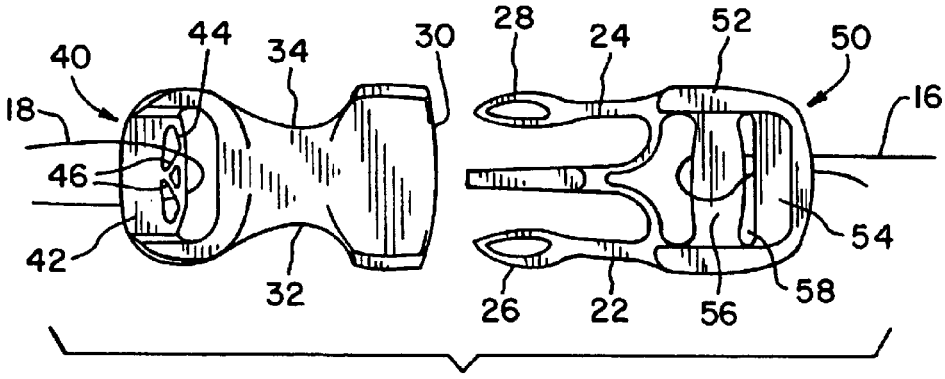
FIG. 3 is a top plan view of the buckle as shown in FIG. 2.

Buckle 10 can be associated with a variety of different articles, such as luggage, clothing, safety equipment or the like. Male buckle part 12 is attached to one article or part of an article and, as illustrated, is shown attached to a strap 16. Female buckle part 14 is anchored to another article or part of an article such as a strap 18 illustrated in the drawings. It should be understood that straps 16 and 18 also could be opposite ends of a single piece of webbing, such as when buckle 10 is used for a belt. Webs 16 and 18 are illustrated in FIG. 1, and, for clarity, are shown as a line designated with the same reference number in FIGS. 2 and 3.

The manner in which male buckle part 12 is releasably received in and connected to female buckle part 14 is known to those skilled in the art, and may take numerous different configurations. In the exemplary embodiment shown, a connecting structure 20 is provided, including male buckle part 12 having forward projecting arms 22 and 24, with enlargements or lateral projections 26 and 28. Female buckle part 14 defines therein a hollow chamber or pocket 30 having lateral windows 32 and 34. Windows 32 and 34 are sized and arranged to receive therein projections 26 and 28 from arms 22 and 24, respectively. Arms 22 and 24 deflect inwardly as male buckle part 12 is inserted into female buckle part 14, and spring outwardly to expose projections 26 and 28 through windows 30 and 32 of female buckle part 14, as male buckle part 12 is fully inserted. Male buckle part 12 is released from female buckle part 14 by pushing inwardly on projections 26 and 28 while urging male buckle part 12 and female buckle part 14 in opposite directions.

In accordance with the present invention, each male buckle part 12 and female buckle part 14 is provided with integral springing structures for absorbing tensile load exerted against locking structure 20 or against the individual buckle parts 12 and 14.

Female buckle part 14 includes a first strap securing structure 40, by which strap 18 is secured to female buckle part 14. Structure 40 has a base bar 42 and a deflectable bar 44 spaced from each other. Deflectable bar 44 is relatively thin compared to base bar 42, and base bar 42 is less deflectable than deflectable bar 44. Strap 18 is wrapped jointly around base bar 42 and deflectable bar 44 in a simple loop, doubled back against itself. The overlapping end portion of strap 18 is secured to itself by sewing, riveting, adhering or other such fastening system (not shown). Fastened in this manner, the effective length of strap 18 is not readily adjustable. Depending on the width of strap 18, the strength and resiliency of the material from which buckle 10 is made and the anticipated forces to be experienced, a series of truss support members 46 are provided between base bar 42 and deflectable bar 44. For narrow buckles 10, and for lightweight applications, truss support members 46 are not required. Tensile forces exerted on buckle 10 are absorbed, at least partly, by movement or deflection of deflectable bar 44.

Figure 5:
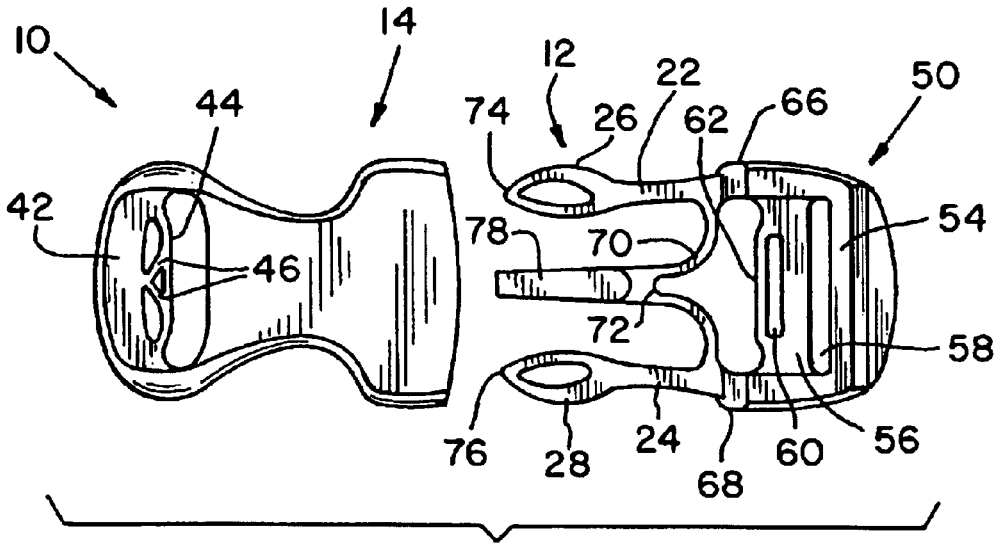
FIG. 5 is a plan view similar to FIG. 3, but showing the bottom of the buckle.

Male buckle part 12 has an adjustable second strap securing structure 50 by which strap 16 is held in position relative to male buckle part 12. Strap securing structure 50 includes a body 52 defining a rearward first web engaging bar 54 and a forward second web engaging bar 56 spaced from each other to form a web-receiving slot 58. Strap 16 is routed in serpentine fashion through body 52, entwining around bars 54 and 56, in known manner, as illustrated. The effective length of strap 16 is adjusted by moving the position of male buckle part 12 along the length of strap 16. Forward bar 56 includes a cavity 60 (FIGS. 2 and 5) extending substantially the length thereof to form a narrow, deflectable forward edge 62. Portions of bar 56 rearward of cavity 60 are less deflectable than forward edge 62. Strap 16 wraps a substantial portion of forward bar 56, including deflectable forward edge 62 and less deflectable portions of bar 56. Under severe loading conditions, forces exerted on male buckle part 12 by strap 16 result in a large torque against forward edge 62, due to the lacing configuration for strap 16 in securing structure 50. Forces exerted on buckle 10 in this manner are absorbed, at least partly, by movement or deflection of deflectable forward edge 62.

Figure 4:
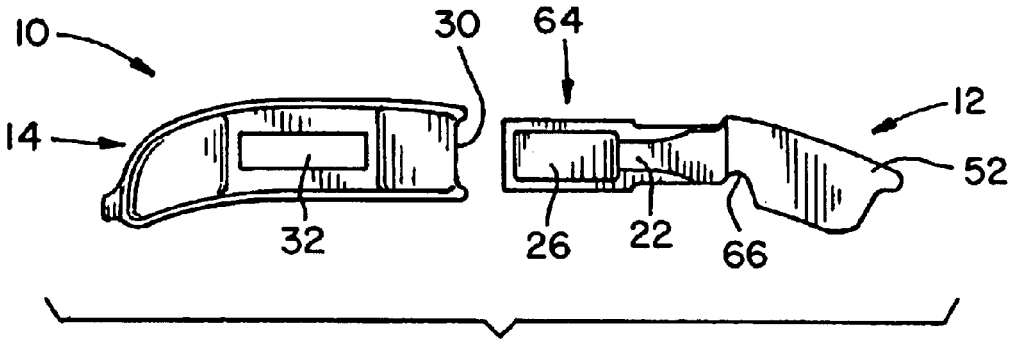
FIG. 4 is a side elevational view of the buckle as shown in FIG. 2.

Arms 22 and 24 project forwardly from body 52, substantially parallel to each other, but not in linear alignment with body 52. As seen most clearly in FIG. 4, a forward portion 64 of male buckle part 12, including arms 22 and 24 thereof, is disposed at an angle relative to, and not in linear alignment with body 52. Arms 22 and 24 are joined to body 52 by thinned connecting segments 66 and 68, respectively, preferably formed from an undercut on the inside of the angle formed between forward portion 64 and body 52. In this manner, connecting segments 66 and 68 function as a hinge, allowing some relative movement between forward portion 64 and body 52. Again, forces exerted on buckle 10 through straps 16 and 18 are absorbed, at least partly, by relative movement between forward portion 64 and body 52, in hinge-like manner about connecting segments 66 and 68.

In addition to arms 22 and 24, forward portion 64 of male buckle part 12 includes a brace 70 connected between arms 22 and 24, at bases thereof just forward of connecting segments 66 and 68. Brace 70 is of a generally curved v-shape, provided in essentially the same plane as arms 22 and 24. Brace 70 has a central portion 72, or apex, thereof angling toward distal ends 74 and 76 of arms 22, and 24, respectively. In cooperation with thinned connecting segments 66 and 68, curved brace 70 facilitates lateral movement of distal ends 74 and 76, while also providing reinforcement against breaking of arms 22 and 24. As a result of the hinge-like effect created by connecting segments 66 and 68, and by the curved v-shape of brace 70, arms 22 and 24 can be made of heavy, strong material, yet still can be deflected as necessary for connecting and disconnecting male buckle part 12 from female buckle part 14. Arms 22 and 24 can be made sufficiently strong to resist breaking without becoming unacceptably difficult to deflect laterally as required for using buckle 10.

A guide pin 78 projects forwardly from brace 70, at central portion 72 thereof, substantially in the same plane as arms 22 and 24. Pin 78 is received in a guide slot of pocket 30, to direct and align forward portion 64 as it is inserted into pocket 30.

Although male buckle part 12 has been shown and described herein with an adjustable strap securing structure 50, and female buckle part 14 has been shown and described with a nonadjustable strap securing structure 40, it should be understood that, in some applications and uses for buckle 10, both buckle parts 12 and 14 can be provided with adjustable strap securing structures 50. Alternatively, both buckle parts 12 and 14 can be provided with nonadjustable strap securing structures 40, or male buckle part 12 can be provided with a nonadjustable strap securing structure 40 and female buckle part 14 can be provided with an adjustable strap securing structure 50. The advantages obtained from the various integral springing structures described are realized regardless of its association with a male or female buckle part 12 or 14, or any particular strap securing structure.

In the use of the present invention, normal operations to connect and disconnect male buckle part 12 and female buckle part 14 are undertaken in known fashion. To connect the buckle parts, male buckle part 12 is inserted into pocket 30 of female buckle part 14. The tapered, rounding configurations of distal ends 74 and 76 engage inside surfaces of pocket 30 to deflect the arms inwardly as forward portion 64 is forced into pocket 30. Laterally extending portions of projections 26 and 28 align with windows 32 and 34, allowing arms 22 and 24 to move outwardly toward the unbiased positions of each. Male buckle part 12 is thereby connected to female buckle part 14, with projections 26 and 28 extending outwardly through windows 32 and 34. To disconnect buckle parts 12 and 14, projections 26 and 28 are squeezed together, pushing each inwardly and thereby out of windows 32 and 34, while simultaneously urging buckle parts 12 and 14 apart.

During normal, expected and designed use of buckle 10, the various springing structures are not required. However, if an excessive load or a shock load is applied to buckle 10 through straps 16 and 18, the various springing structures operate to absorb at least some of the load, reducing the potential for breakage or accidental disconnect of buckle parts 12 and 14. Deflectable bar 44 and deflectable forward edge 62 each can move from force applied directly thereto by straps 16 and 18. The angular relationship between forward portion 64 and body 52 can flatten, as movement occurs about connecting segments 66 and 68. Each of these movements absorbs energy applied to buckle parts 12 and 14, lessening any devastating impact. Even if thicker arms 22 and 24 are used to withstand breakage, deflection of distal ends 74 and 76 is facilitated without having to lengthen arms 22 and 24, as a result of the hinging effect of thinned connecting segments 66 and 68 and curved brace 70.

The present invention is particularly suitable for use in two-part buckles of various configurations, including those different from the exemplary embodiment described. For example, the various, integral, springing structures described also can be used in two-part buckles having only one or more than two arms. The deflectable bars of strap securing structures 40 and 50 can be used advantageously for other devices connected to straps, including buckles of other types as well as for structures other than buckles. Advantageous strap securing structures of the present invention include a deflectable portion and a less deflectable portion jointly wrapped by the strap. The springing structures described relative to body 52 and forward portion 64 also can be used with other structures.

The present invention provides a buckle and individual buckle components that can withstand shock loads applied to the buckle such as by jerking the straps or articles attached to the buckle. A male buckle component can be provided with strong, thicker arms without making the buckle difficult to operate. The flexing design of the buckle parts, with increased strength makes stronger more compact buckles possible.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A two-part buckle, comprising:

a female buckle part defining a pocket, and including a first strap securing structure;

a male buckle part including a forward portion insertable into said pocket and including a second strap securing structure;

said female buckle part and said male buckle part defining cooperative releasable locking structure; and springing structure integral with said buckle parts for moving to absorb load exerted on said locking structure, said male buckle part including a thinned connecting segment between said forward portion and said second strap securing structure allowing deflection of said forward portion relative to said second strap securing structure.

2. A two-part buckle, comprising:

a female buckle part defining a pocket and including a first strap securing structure;

a male buckle part including a forward portion insertable into said pocket and including a second strap securing structure;

said female buckle part and said male buckle part defining cooperative releasable locking structure; and springing structure integral with said buckle parts for moving to absorb load exerted on said locking structure, said forward portion including first and second spaced arms, each said arm having a distal end adapted for engaging and disengaging said female buckle parts by movement of said distal end, and a brace connected to and between said arms, said brace having a central portion between said arms angling towards said distal ends.

3. The two-part buckle of claim 2, said male buckle part including a thinned connecting segment between said forward portion and said second securing structure allowing deflection of said forward portion relative to said second strap securing structure.

4. The two-part buckle of claim 3, said springing structure including a deflectable bar associated with at least one of said first and second strap securing structures.

5. The two-part buckle of claim 4, said at least one of said first and second strap securing structures including a base bar and said deflectable bar spaced from each other.

6. The two-part buckle of claim 5, said at least one of said first and second strap securing structures including truss support members between said base bar and said deflectable bar.

7. A two-part buckle, comprising:

a female buckle part defining a pocket, and including a first strap securing structure;

a male buckle part including a forward portion insertable into said pocket and including a second strap securing structure;

said female buckle part and said male buckle part defining cooperative releasable locking structure; and springing structure integral with said buckle parts for moving to absorb load exerted on said locking structure, said springing structure including a bar of one of said strap-securing structures having a deflectable forward edge and a less deflectable portion adjacent said deflectable forward edge.

8. A male buckle part for a two-part buckle having a female buckle part defining a pocket having lateral windows and a slot, said male buckle part comprising;

a body;

first and second spaced arms extending from said body and adapted and arranged for sliding into and out of the pocket in the female buckle part, said arms having lateral projections received in the windows; and a brace connected to each said arm near said body, said brace extending from one of said arms to the other of said arms and having a central portion angling away from said body between said arms.

9. The male buckle part of claim 8, including a guide pin extending outwardly from said brace, between said arms, arranged with said arms for sliding into the slot in the pocket.

10. The male buckle part of claim 8, including connecting segments between said arms and said body, and an undercut in said connecting segments.

11. The male buckle part of claim 10, said arms disposed at an angle relative to said body, and said undercut disposed on an inside of said angle.

12. The male buckle part of claim 11, including a guide pin extending outwardly from said brace, between said arms.

13. A strap securing structure for a device to be held on a strap, said strap securing structure comprising;

a deflectable portion about which a strap can be wrapped, adapted for yielding to load applied against said strap securing structure by a strap secured thereto; and a less deflectable portion associated with said deflectable portion, said portions being jointly wrapped by the strap;

said portions provided on a single bar by a cavity disposed near an edge of said bar separating said deflectable portion from said less deflectable portion.

* * * * *